United States Patent [19]

Ringelhan

[11] 4,206,683

[45] Jun. 10, 1980

[54] ELECTRICAL FIRING SYSTEM FOR WEAPONS

[75] Inventor: Wolfgang Ringelhan, Duesseldorf, Fed. Rep. of Germany

[73] Assignee: Rheinmetall GmbH, Duesseldorf, Fed. Rep. of Germany

[21] Appl. No.: 946,659

[22] Filed: Sep. 28, 1978

[30] Foreign Application Priority Data

Sep. 29, 1977 [DE] Fed. Rep. of Germany ..... 2743770

[51] Int. Cl.[2] ..... F41D 11/16

[52] U.S. Cl. ..... 89/28 A

[58] Field of Search ..... 42/84; 89/1.814, 28 R, 89/28 A, 135

[56] References Cited

U.S. PATENT DOCUMENTS 800,663 10/1905 Meigs et al. ..... 89/28 A 2,466,929 4/1949 Catlin et al. ..... 89/28 R

*Primary Examiner*—Stephen C. Bentley

[57] ABSTRACT

There is disclosed an electric firing system adapted for weapons adapted for firing ammunition with a combustible casing or without a propellant charge casing, with an electrically conducting contact pin having an insulated body and an igniter point which is arranged in the bore of a breech block so as to be axially removable from the rest position to a firing position and back again into the rest position, and which is connectable with a voltage source when moved toward and into its firing position. In the disclosed system the contact pin in its rest position is in conducting contact with the mass of the breech block. A repeater lever is arranged with respect to the contact pin in such way that it moves the latter into the operating position against a restoring force, thereby electrically energizing the contact pin, and thereafter releases it to return to its rest position. In the rest position of the contact pin a cover member seals the end of the bore in which the contact pin is located from the bore of the barrel of the weapon.

3 Claims, 1 Drawing Figure

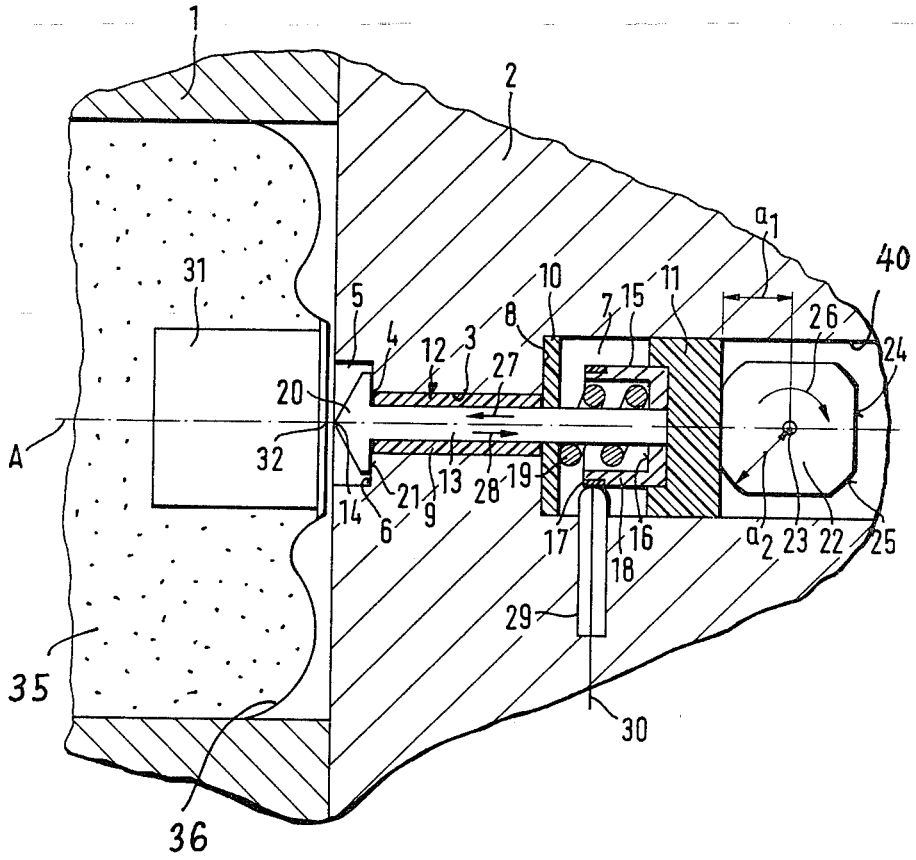
1
2
31
5
4
12
3
27
10
8
7
15
11
$a_1$
40
26
24
20
A
32
14
21
6
9
13
28
19
17
16
18
29
$a_2$
23
22
25
35
36
30

ELECTRICAL FIRING SYSTEM FOR WEAPONS

This invention relates to an electrical firing system for weapons, and is adapted for firing ammunition with a combustible casing or without a propellent charge casing.

When electrically firing ammunition with a combustible casing or without a propellent charge casing, the necessary insulating materials are subjected to the highest thermal and pressure stresses; these lead to damaging changes or destruction in even the most resistant materials. This disadvantage is not outweighed by the numerous advantages of electrically fired ammunition with a combustible casing or without a propellent charge casing because the disadvantage limits the availability of the particular weapon to an unacceptable degree.

The present invention has among its objects the elimination of the aforesaid disadvantages of the prior art, and thus to widen the design possibilities for the respective weapons.

This object is achieved by the provision of an electric firing system for weapons, adapted for firing ammunition with a combustible casing or without a propellent charge casing, with an electrically conducting contact pin having an insulator body and an igniter point which is arranged in a bore of a breech block so as to be axially movable from a rest position to a firing position and back again into the rest position, and which is connectible with a voltage source when moved toward and into its firing position.

In the disclosed system the contact pin in its rest position is in conducting contact with the mass of the breech block, a repeater lever is arranged with respect to the contact pin in such a way that it moves the latter into the operating position against a restoring force and releases it into the rest position on its return, and in the rest position of the contact pin a cover member seals one end of the bore in which the contact pin is located.

Further advantageous features of the disclosed electrical firing system of the invention are the provision of a cover member fixed to the contact pin directly adjacent the ignition point, the fact that the rear side of the cover member facing the breech block is electrically conducting, and that the rear side of the cover member is electrically connected with the contact pin. The system of the invention makes possible the use of inexpensive insulating materials, thereby markedly increasing the availability of a particular weapon to the firing of ammunition with a combustible casing or without a propellent charge casing.

The invention is described in greater detail below with the aid of the accompanying drawing, in which:

The single FIGURE is a schematic view in longitudinal axial section through the rear part of the barrel and the breech block of a weapon provided with an electric firing system in accordance with the invention, parts not essential to the illustration of the invention having been omitted from the drawing.

Turning now to the drawing, there is shown the rear end of the barrel 1 of a weapon, such barrel having a central longitudinal axis A. Abutting the rear end of the barrel 1 is a breech block 2 which may be selectively locked to the barrel by means not shown. In its closed, locked position the breech block 2 lies in alignment with the axis A of the barrel. The breech block has a passage or bore therethrough coaxial of the axis A, such passage consisting of a relatively large diametered rear portion

40, an intermediate, smaller diametered portion 3, and a forward portion 5 which is of somewhat larger diameter than the portion 3. The portions 40 and 3 of the passage are joined at a transverse shoulder 8, and the poriton 3 and 5 of the bore are joined at a transverse shoulder 6. The portion 40 of the bore has a chamber 7 therewithin.

A contact pin 12 disposed in the portion 3 of the bore in the breech block has a central metal shaft 13; shaft 13 surrounded by an insulating sleeve 9 which is affixed to the breech block. The contact pin 12 is arranged for reciprocation in the sleeve 9, as indicated by the arrows 27 and 28. At its forward end the shaft 13 is provided with an enlarged head 20 which is disposed within the portion 5 of the bore in the breech block, head 20 having a forward surface in the form of a cone the apex of which constitutes an ignition point 14. The head 20 is joined to the forward end of the shaft 13 at a transverse annular shoulder 21.

At the forward end of the chamber 7 within the portion 40 of the passage in the breech block there is disposed a transverse insulating plate member 10 through which the shaft 13 of the contact pin 12 extends and with respect to which it reciprocates. The rear end of the shaft 13 is fixedly secured as by welding or the like to the inner surface of the closed end or base 16 of a cup-shaped metal member 15 which functions as a cage for a coil compression spring 19 which surrounds the rear end of the shaft 13, the rear end of the spring abutting the base 16 of the spring cage 15. The forward end of the spring 19 abuts the insulating plate 10. It will be seen that the coil compression spring 19 constantly urges the contact pin 12 rearwardly (to the right). Slidingly fitted within the portion 40 of the passage is an insulating body 11 having a shallow central seat in its forward face, such seat receiving the rear end of the spring cage 15.

A rotatable cam member 22, operated by a repeater lever (not shown) is mounted on a transverse shaft 23 intersecting and disposed normal to the axis A. The cam member 22 has a generally square cross setion with main edges 24, the corners of member 22 being symmetrically bevelled to present surfaces 25 lying at a distance $a_2$ from the axis of the shaft 23. The edge surfaces 24 lie at a distance $a_1$, which is less than $A_2$, from the axis of shaft 23. When the cam 22 lies in the position shown in the drawing, with a surface 24 in broad engagement with the rear surface of the insulator block 11, the contact pin 12 is in its rearmost position, with the surface 21 on the rear of the head 20 of the contact pin sealingly engaging the shoulder 21 of the breech block and in electrically conducting relationship therewith.

An electrically insulating annular sleeve 17 is disposed in an radially outer groove at the forward end of the sidewall of the spring cage 15. Confronting such insulating portion 17 and in engagement therewith, when the parts are in the at-rest positions they occupy in the drawing, is an electrical contact 29 having a cable 30 leading therefrom and connectible to a suitable source of electric current (not shown). The cam member 22 is turned 90° about its axis in the direction of the arrow 26 to fire the weapon. During such rotation of the cam member the assembly of the insulating block 11, the spring cage 15, and the contact pin 12 is moved forwardly far enough for the metallic portion 18 of spring cage 15 to engage the contact 29 and thereby to energize the contact pin 12 at the same time the head 20 of the ignition pin is removed from contact with the breech block. Such forward movement of the contact pin also brings the ignition point 14 of the cover member 20 on the contact pin close enough to the metallic rear member 32 of a sheath covering an igniter charge 31 to generate a spark therebetween. This, in turn, ignites the powder charge 35 in the charge chamber 34, the powder charge being shown contained in the fragmentarily illustrated combustible casing 36. By the time of the ignition of the powder charge 35 the cam member 22 will have reached the position shown in the drawing, with the succeeding edge surface 24 squarely in engagement with the rear surface of insulating block 11. The force of the detonation of the ignited charge 31 and of the powder charge 35 act upon the head 20 of the contact pin, thereby to drive it rearwardly into the position shown in the drawing, whereby to seal the contact pin proper and the means in the breech block rearwardly thereof against the action of the detonated ignited charge and powder charge.

The above described electric firing system operates as follows. In order to initiate the firing process, a repetition lever (not shown) connected to the cam 22 is turned to turn such cam in the direction of the arrow 26. This causes one of the surfaces 25 to move into a position transverse to the axis A and by contact with the insulator body 11 moves the contact pin 12 from its rest position in axial direction shown by the arrow 27 against the return force of the return spring 19 and into the operating position. During this moment the annular rear shoulder surface of the head 20 lifts off the surface 21 on the breech, and the conducting part 18 of the spring cage 15 makes contact with the propellent charge igniter 31 at point 32 in order to start the firing process. The latter operation closes a firing circuit. Further turning of the cam 22 in the direction of the arrow 26 again causes one of the surfaces 24 to be moved into a position transverse to the axis A, so that the contact pin 12 suddenly returns to its rest position in the direction of the arrow 28 under the force of the return spring 19. This causes the rear side surface 21 of the head 20 of the contact pin to close the forward end 4 of the bore 3 facing the barrel by resting against the base 6 of the recess 5. This protects the insulator body 9 surrounding the shaft 13 from the damaging effect of the hot propellent charge gases being developed during firing.

Since the rear side 21 of the head 20 is perfectly adapted to be electrically conducting, the contact pin 12 is insulated from the breech block essentially only at the time of firing of the weapon. As soon as the contact pin is returned to its rest position, the weapon is protected against unwanted firing, in other words, there is a short circuit between the mass of the breech block 2 and the contact pin 12, while the contact switch 29 again rests against the insulated part 17 of the spring cage 15. This advantageous arrangement is a valuable safeguard against the accidental firing of the weapon.

It is to be understood that the electrical firing system of the invention can also be used with barrel weapons using ammunition with propellent charges casings such as well known metallic shell casings.

Although the invention is illustrated and described with reference to one preferred embodiment thereof, it is to be expressly understood that it is in no way limited to the disclosure of such a preferred embodiment, but is capable of numerous modifications within the scope of the appended claim.

What is claimed is:

1. An electric firing system adapted for weapons firing ammunition with combustible casing or without a propellent charge casing, such system comprising an electrically conducting contact pin having an insulator body and an igniter point which is arranged in a bore of a breech-block to be axially movable from a rest position to a firing position and back again into the rest position and which is connectable with a voltage source, the contact pin in its rest position being in electrically conducting contact with the mass of the breech block, means to move the contact pin into the operating position against a restoring force and to release it into the rest position on its return, and a cover member, the cover member sealing one end of the bore in the breech block when the contact pin is in its rest position.

2. An electric firing system according to claim 1, wherein the cover member is fixed to the contact pin directly adjacent the igniter point of the propellent charge.

3. An electric firing system according to claim 2, wherein the cover member is disc-shaped, the lower side of the cover member facing the breech-block is electrically conducting, and the lower side of the cover member is electrically connected with the contact pin.

* * * * *